US008550461B2

(12) United States Patent
Sekigawa et al.

(10) Patent No.: US 8,550,461 B2
(45) Date of Patent: Oct. 8, 2013

(54) SHEET STACKING APPARATUS AND IMAGE FORMING APPARATUS

(75) Inventors: Akito Sekigawa, Abiko (JP); Daisaku Kamiya, Abiko (JP); Kiyoshi Watanabe, Matsudo (JP); Yusuke Obuchi, Nagareyama (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/489,684

(22) Filed: Jun. 6, 2012

(65) Prior Publication Data

US 2012/0326379 A1 Dec. 27, 2012

(30) Foreign Application Priority Data

Jun. 23, 2011 (JP) ..... 2011-139033
May 24, 2012 (JP) ..... 2012-118255

(51) Int. Cl.
*B65H 5/02* (2006.01)
*B65H 5/04* (2006.01)

(52) U.S. Cl.
USPC ..... 271/277; 271/220; 271/189; 271/190; 271/191

(58) Field of Classification Search
USPC ..... 271/189–191, 220, 275, 277; 270/52.14, 52.16, 52.26
See application file for complete search history.

(56) References Cited

U.S. PATENT DOCUMENTS 3,924,848 A * 12/1975 Murakami ..... 271/10.1
4,069,728 A * 1/1978 McCrea ..... 83/409
4,109,779 A * 8/1978 Bauer et al. ..... 400/584
4,110,025 A * 8/1978 Tabata ..... 399/401
4,203,590 A * 5/1980 Blessing ..... 271/265.01
4,505,378 A * 3/1985 Statkus ..... 198/710
6,477,348 B2 11/2002 Miyamoto et al.
6,478,297 B1 * 11/2002 Messerschmid ..... 271/277
6,801,726 B2 10/2004 Shimizu et al.
7,941,063 B2 5/2011 Suzuki et al.
8,146,904 B2 4/2012 Watanabe et al.
8,172,224 B2 5/2012 Kushida
2010/0072697 A1 * 3/2010 Sokolowski ..... 271/277
2010/0254721 A1 10/2010 Fukita et al.
2012/0235350 A1 9/2012 Watanabe et al.

FOREIGN PATENT DOCUMENTS

JP 9-077301 A 3/1997

* cited by examiner

*Primary Examiner* — Prasad Gokhale

(74) *Attorney, Agent, or Firm* — Fitzpatrick, Cella, Harper & Scinto

(57) ABSTRACT

A sheet stacking apparatus includes an endless belt member onto which sheets are stacked and which moves rotationally to convey the sheets; a plurality of holding members that is provided on the belt member and that holds the sheets down to a sheet stacking surface of the belt member to nip the sheets; and sheet detecting portions which detect presence or absence of sheets between the holding members and the sheet stacking surface of the belt member, the sheet detecting portions each include a light emitting portion that emits light and a light receiving portion that receives the light, and the light emitting portions and the light receiving portions are fixedly provided below the sheet stacking surface of the belt member so that the light emitting portions and the light receiving portions detect presence or absence of a sheet at times when facing the holding members.

16 Claims, 15 Drawing Sheets

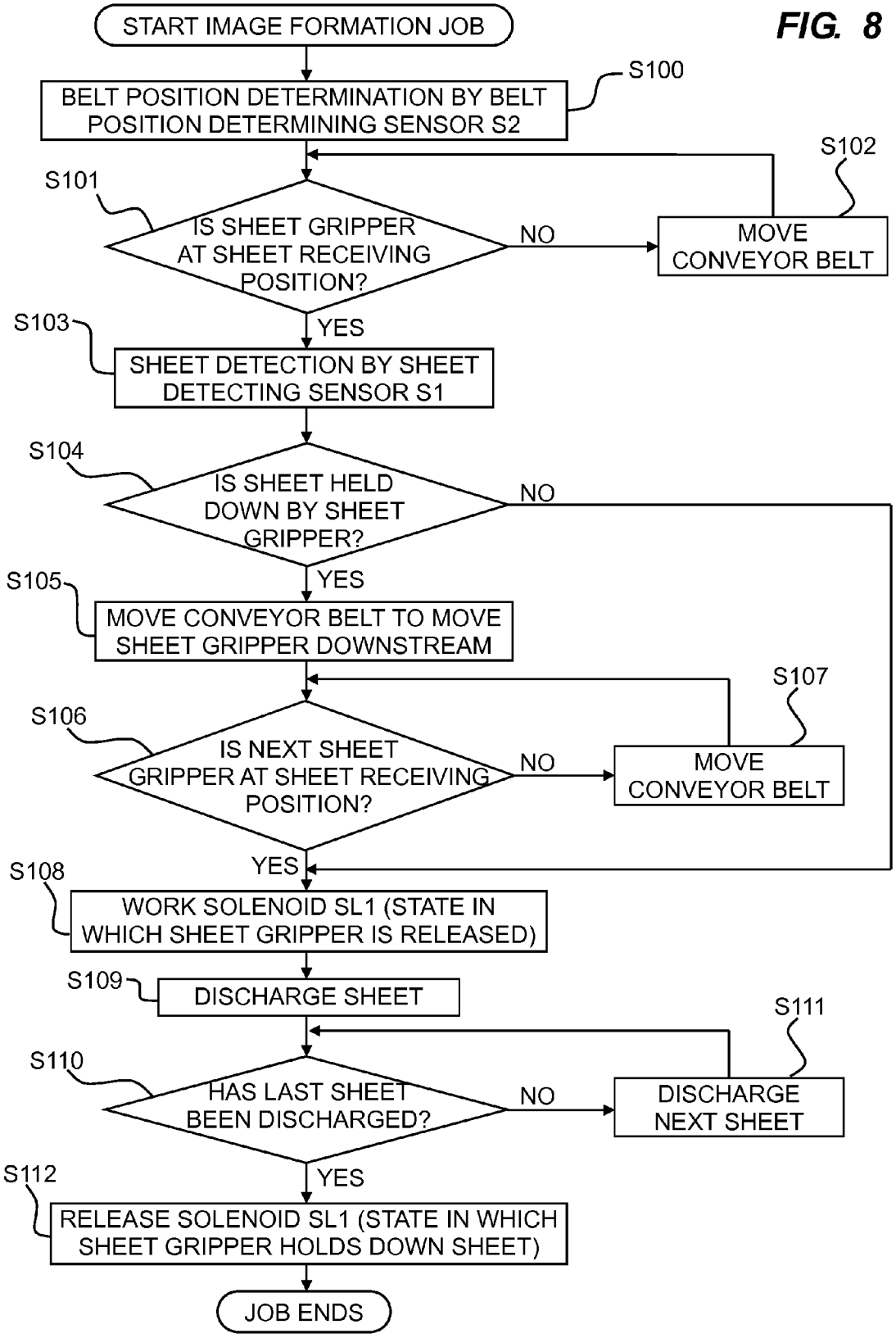
FIG. 8
START IMAGE FORMATION JOB
S100
BELT POSITION DETERMINATION BY BELT POSITION DETERMINING SENSOR S2
S101
IS SHEET GRIPPER AT SHEET RECEIVING POSITION?
NO
S102
MOVE CONVEYOR BELT
YES
S103
SHEET DETECTION BY SHEET DETECTING SENSOR S1
S104
IS SHEET HELD DOWN BY SHEET GRIPPER?
NO
YES
S105
MOVE CONVEYOR BELT TO MOVE SHEET GRIPPER DOWNSTREAM
S106
IS NEXT SHEET GRIPPER AT SHEET RECEIVING POSITION?
NO
S107
MOVE CONVEYOR BELT
YES
S108
WORK SOLENOID SL1 (STATE IN WHICH SHEET GRIPPER IS RELEASED)
S109
DISCHARGE SHEET
S110
HAS LAST SHEET BEEN DISCHARGED?
NO
S111
DISCHARGE NEXT SHEET
YES
S112
RELEASE SOLENOID SL1 (STATE IN WHICH SHEET GRIPPER HOLDS DOWN SHEET)
JOB ENDS

SHEET STACKING APPARATUS AND IMAGE FORMING APPARATUS

BACKGROUND OF THE INVENTION

1. Field of the Invention

The present invention relates to a sheet stacking apparatus onto which sheets are stacked and to an image forming apparatus provided with one of the sheet stacking apparatuses.

2. Description of the Related Art

As one example of sheet stacking apparatuses onto which sheets are stacked, a sheet stacking apparatus, in which an upper gripper 66 and a lower gripper 67 nip a sheet bundle and which move the sheets as shown in FIG. 15, has been heretofore used (see Japanese Patent Laid-Open No. 9-77301). Near the grippers 66 and 67, a phototransmissive sheet detecting portion 301, which can detect the sheet bundle, is provided in a manner that can be moved along with the grippers 66 and 67. The sheet detecting portion 301 includes a light emitting portion 301*a*, a light receiving portion 301*b*, and a prism 302. Light emitted by the light emitting portion 301*a* is diffracted by the prism 302, and then transmitted to the light receiving portion 301*b*. With the detection of the sheet bundle between the grippers 66 and 67, since light from the light emitting portion 301*a* is blocked by the sheets, the presence of the sheets can be detected.

In the apparatus described in Japanese Patent Laid-Open No. 9-77301, since the light emitting portion 301*a*, the light receiving portion 301*b*, and the prism 302 are provided near the grippers 66 and 67, the presence or absence of sheets can be monitored even when the grippers 66 and 67 are moving.

However, pencils of light rays from the light emitting portion 301*a* and the light receiving portion 301*b* must be transmitted across the range of the movement of the grippers 66 and 67, and it is also necessary to prevent the interminglement of the pencils, whereby the structure of the sheet stacking apparatus becomes complex.

Moreover, even when there is no sheet bundle between the grippers 66 and 67, another sheet sometimes enters between the upper gripper 66 and the light emitting portion 301*a*, and therefore the sheet is wrongly detected.

SUMMARY OF THE INVENTION

The present invention provides a sheet stacking apparatus in which a sheet nipped by a gripper can be detected precisely without using any complex structure.

According to the present invention, there is provided a sheet stacking apparatus including: an endless belt member onto which sheets are stacked and which moves rotationally to convey the sheets; a plurality of holding members that is provided on the belt member and that holds the sheets down to a sheet stacking surface of the belt member to nip the sheets; and sheet detecting portions which detect presence or absence of sheets between the holding members and the sheet stacking surface of the belt member, the sheet detecting portions each include a light emitting portion that emits light and a light receiving portion that receives the light from the light emitting portion, and the light emitting portions and the light receiving portions are fixedly provided below the sheet stacking surface of the belt member so that the light emitting portions and the light receiving portions detect presence or absence of a sheet at times when facing the holding members.

According to the present invention, sheets other than a sheet to be nipped do not enter between a holding member and a sheet detecting sensor, and thus the presence of the sheet held down by the holding member can be detected more precisely. That is, even when another sheet is partly put on the holding member, the sheet held down by the holding member can be detected precisely; therefore, even in a case where a plurality of holding members is placed and several sets of sheets are stacked with the sheets in imbricate state, the presence or absence of the sheets at each of the holding members can be detected.

Further features of the present invention will become apparent from the following description of exemplary embodiments with reference to the attached drawings.

BRIEF DESCRIPTION OF THE DRAWINGS

FIG. 8 is a flowchart of the operation of the sheet stacking conveyor portion according to the present invention;

DESCRIPTION OF THE EMBODIMENTS

Exemplary embodiments of the present invention will be described in detail below with reference to the drawings; note that materials for and sizes, shapes, relative positions, and so on of components described in the following embodiments should be changed as appropriate according to the structures of apparatuses to which the present invention is applied and various conditions. Therefore the scope of the invention is not intended to be limited to the embodiments unless otherwise specified.

First Embodiment

A Sheet Stacking Apparatus according to a first embodiment of the present invention and an image forming apparatus provided with the sheet stacking apparatus will now be described.

(Image Forming Apparatus)

Figure 1:
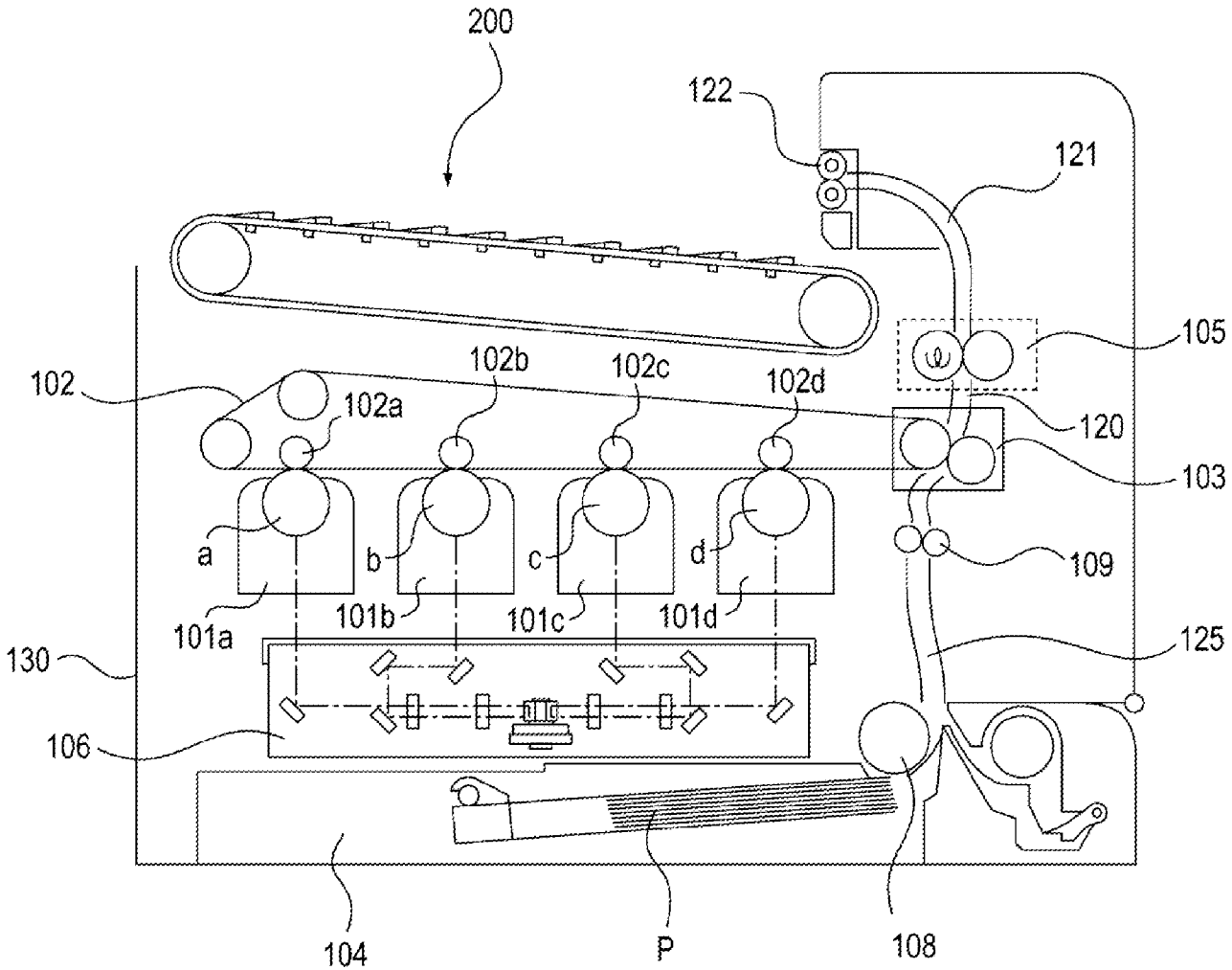
FIG. 1 is a cross-sectional view of an image forming apparatus according to the present invention.

FIG. 1 is a schematic cross-sectional view of a sheet stacking conveyor 200 as a sheet stacking apparatus and of an image forming apparatus 130 provided with the conveyor 200 at a discharging portion. As shown in FIG. 1, the image forming apparatus 130 is provided with four image forming portions placed in parallel. The four image forming portions each form yellow toner images, magenta toner images, cyan toner images, and black toner images: the image forming portions each include a photosensitive drum a (for yellow image formation), a photosensitive drum b (for magenta image formation), a photosensitive drum c (for cyan image formation), and a photosensitive drum d (for black image formation) as an image bearing member. On the tops of the photosensitive drums a to d, an intermediate transfer belt 102 is provided as a transfer conveying portion that runs along the row of the photosensitive drums a to d.

Around each of the photosensitive drums a, b, c, and d to be driven by a motor (not shown), a processing portion (not shown) is placed so as to operate on the photosensitive drum. The four processing portions each include a primary charger, a development device, and a transfer charger: the primary chargers, the development devices, and the transfer chargers are integrated into four units, i.e., into four process cartridges 101*a* to 101*d*. Below the photosensitive drums a to d is placed an exposure device 106 including polygon mirrors.

To begin with, laser light is generated based on an image signal carrying the yellow components of an original document, and then projected onto the photosensitive drum a via the polygon mirror and so on of the exposure device 106 to form an electrostatic latent image on the photosensitive drum a. Then yellow toner is supplied from the development device to perform development, whereby the electrostatic latent image becomes visible as a yellow toner image. With the turn of the photosensitive drum a, the toner image reaches a primary transfer portion where the photosensitive drum a and the intermediate transfer belt 102 abut on each other. Thereafter, a primary transfer bias is applied to a transfer charging member 102*a* to transfer the yellow toner image on the photosensitive drum a onto the intermediate transfer belt 102 (perform primary transfer).

Then the portion bearing the yellow toner image of the intermediate transfer belt 102 moves to the next image forming portion, where a magenta toner image is formed on the photosensitive drum b by using the same method as the method described above. Thereafter, the magenta toner image is transferred onto the intermediate transfer belt 102 in a manner that overlaps with the yellow toner image. Likewise, with the movement of the intermediate transfer belt 102, a cyan toner image and a black toner image are transferred at each of the primary transfer portions of the other respective image forming portions such that these images overlap with the yellow toner image and the magenta toner image.

In the image forming apparatus 130, sheet P is put in a cassette 104 provided at a lower part of the apparatus 130. The sheet P is sent off from the cassette 104 by a pickup roller 108 one by one, and timings of image formation on the sheet P is provided by a pair of resist rollers 109, whereby the sheet P reach a secondary transfer portion in order. Then a secondary transfer bias is applied to a pair of secondary transfer rollers 103 to transfer the four-color toner image on the intermediate transfer belt 102 onto each sheet P (perform secondary transfer).

After the transfer of the four-color toner image, the sheet P is guided to a pair of fixing rollers 105 by a conveying guide 120. Then the sheet P is fixed through the application of heat and pressure, i.e., the toners of the different colors fuse on the sheet P while some of the colors blend partly, whereby a full-color print image is formed on each sheet P. Thereafter, each sheet P is conveyed to the sheet stacking conveyor 200 by a pair of discharge rollers 110 provided downstream from the pair of fixing rollers 105.

(Sheet Stacking Conveyor)

Figure 2:
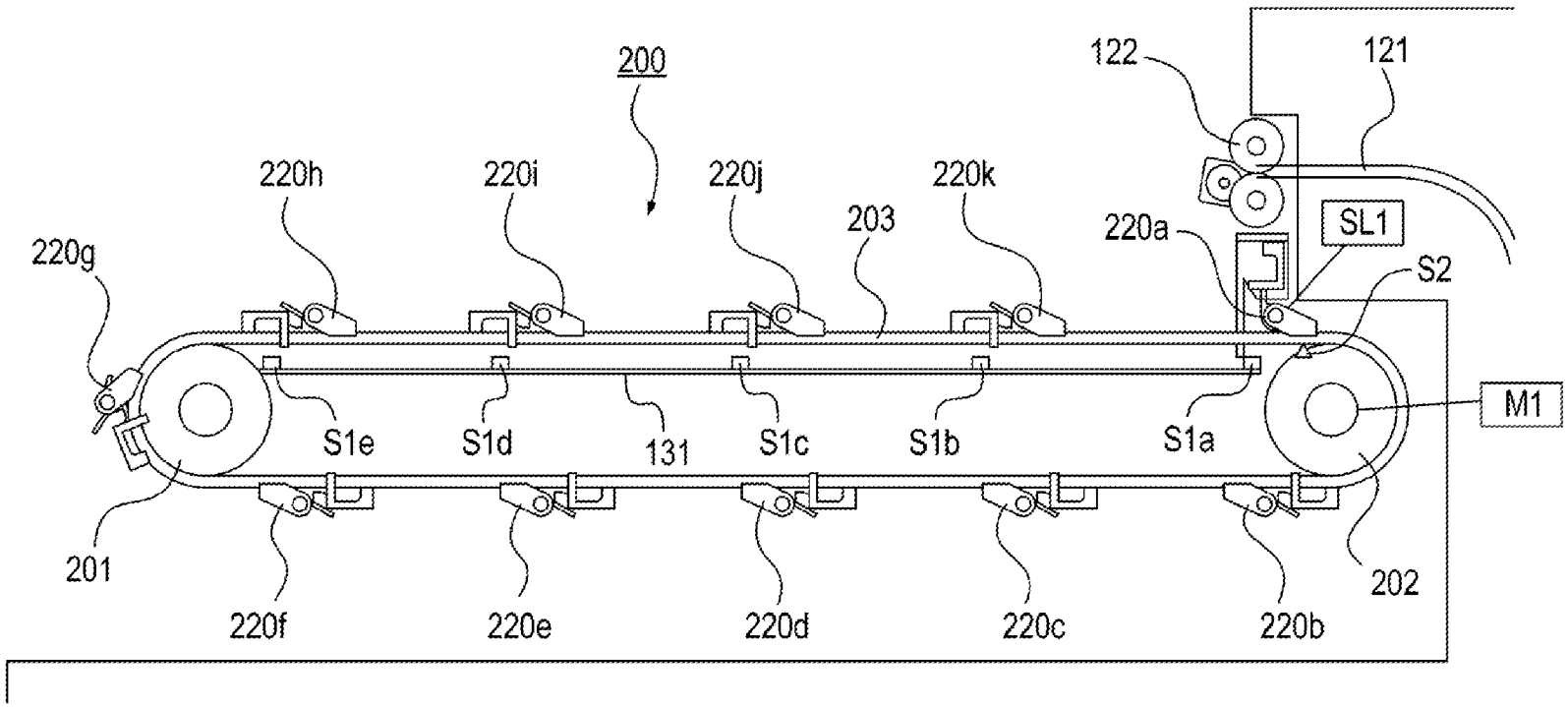
FIG. 2 is a cross-sectional view of a sheet stacking conveyor according to the present invention.

Next, the sheet stacking conveyor 200, onto which discharged sheet are stacked and which conveys the sheet downstream one by one, will be described with reference to FIG. 2.

After the image formation by the image forming apparatus 130, sheet is discharged to the sheet stacking conveyor 200 via a discharge path 121 and a pair of discharge rollers 122, and stacked onto the sheet stacking conveyor 200.

In the sheet stacking conveyor 200, a conveyor belt 203 is looped over a conveyor driving pulley 202 and a conveyor pulley 201. The sheet stacking conveyor 200 is driven by a conveyor driving motor M1 to convey sheet on the conveyor belt 203. The conveyor belt 203 is an endless belt member, which moves rotationally with sheet put on itself 203.

On the periphery (the sheet stacking surface) of the conveyor belt 203, a plurality of sheet grippers 220 (220*a* to 220*k*) is provided at regular spacings in the direction of belt conveyance. The sheet grippers 220 are holding members that can hold the trailing edge of sheet down to the periphery of the conveyor belt 203 at a center of width to nip the sheet. A width of the conveyor belt 203 is less than the width of sheet.

In a region enclosed by the conveyor belt 203 (inside the inner periphery opposite to the sheet stacking surface of the conveyor belt 203), sheet detecting sensors S1 as sheet detecting portions are fixedly placed at the same spacings as those between the sheet grippers 220, i.e., the sheet detecting sensors S1 are provided below the sheet stacking surface of the upper half of conveyor belt 203, and in a position opposed to the sheet grippers 220 at the times of sheet detection. That is, when the sheet grippers 220 have moved directly above the sheet detecting sensors S1, the detection of sheet in the sheet grippers 220 is conducted. A method for detecting sheet will be described in detail later.

Near the pair of discharge rollers 122, a solenoid SL1 is placed to release the grasp of a sheet by the sheet gripper 220. The solenoid SL1 is a part to lift the gripper arm 221 of the sheet gripper 220 having stopped near the pair of discharge rollers 122 to keep the space between the gripper arm 221 and the sheet stacking conveyor 200 at the times of the discharge of a sheet onto the conveyor 200.

(Sheet Gripper)

Figure 3:
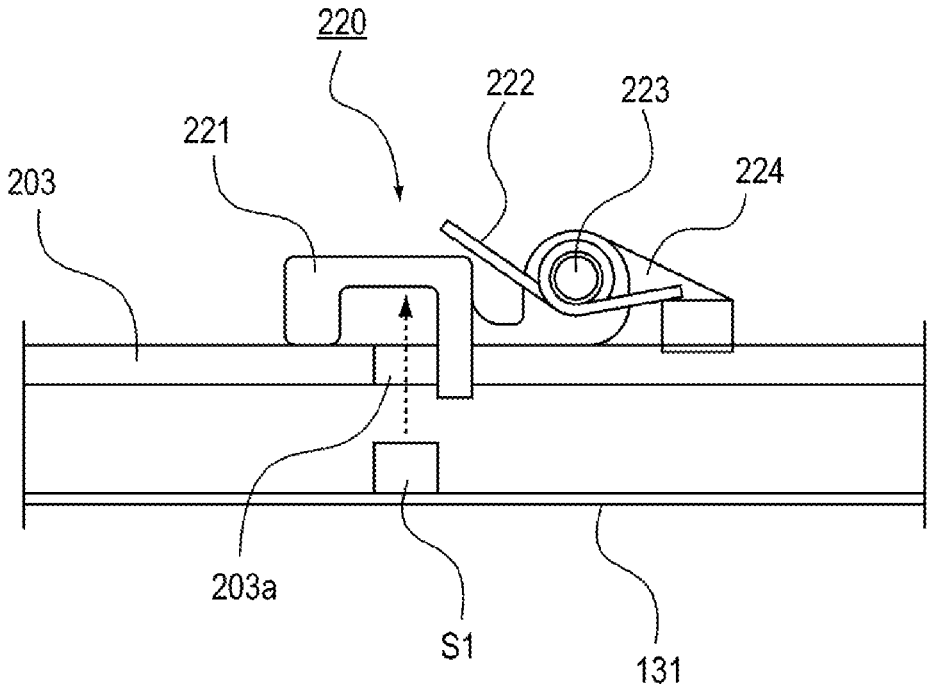
FIG. 3 is a cross-sectional view of a sheet gripper according to the present invention.
Figure 4:
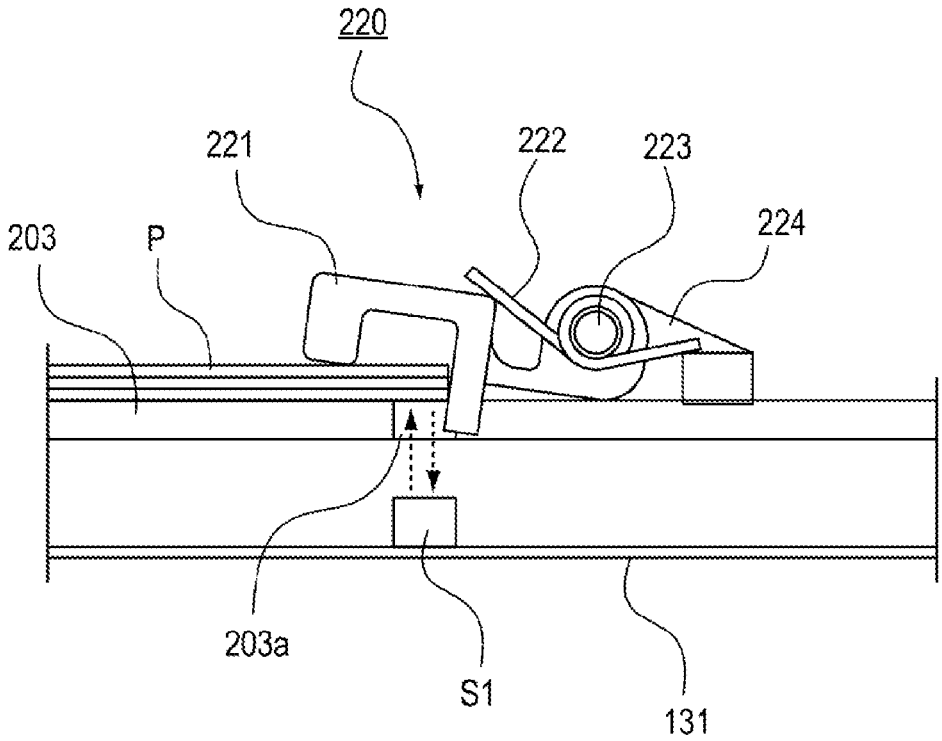
FIG. 4 is a cross-sectional view of the sheet gripper according to the present invention.

The sheet grippers 220, which are used to hold sheets stacked on the conveyor belt 203 down to the periphery of the conveyor belt 203, will be described in detail below with reference to FIGS. 3 and 4. FIGS. 3 and 4 are cross-sectional views of the sheet gripper 220.

In each sheet gripper 220, the gripper arm 221 and a gripper base 224 are coupled using a gripper turning shaft 223, and the gripper base 224 is fixed to the conveyor belt 203. The gripper arm 221, which turns around the gripper turning shaft 223, is pressed down to the conveyor belt 203 with the potential energy of the gripper spring 222 at all times.

The potential energy of the gripper spring 222 is power with which a sheet does not slip or come out when the sheet is being conveyed in a state of being held down by the sheet gripper 220. Therefore the potential energy is set at a power level against which the user can pull a sheet out of the sheet gripper 220 easily.

In the region enclosed by the conveyor belt 203 (at the portion inside the inner periphery of the conveyor belt 203), the sheet detecting sensors S1 are fixedly placed on a sensor mounting plate 131 protruded from the inside wall of the main body of the image forming apparatus 130 to detect the presence or absence of sheets in the sheet grippers 220. The sheet detecting sensors S1 each include a light emitting portion (not shown) that emits light and a light receiving portion (not shown) that receives the light that has been emitted from the light emitting portion and then reflected.

Under each gripper arm 221, a sensor hole 203*a* is made in the conveyor belt 203. Sensor holes 203*a* provided in the conveyor belt 203 are light-path holes used to transmit light emitted from the sheet detecting sensors S1 to the gripper arms 221. The conveyor belt 203 may be made of a transmissive material instead of the sensor hole 203*a*.

The gripper arms 221 are made of a light-absorptive material. Therefore, as shown in FIG. 3, when there is no sheet P under the gripper arm 221, light from the sheet detecting sensor S1 reaches the gripper arm 221 and is then absorbed, and thus the light is not reflected to the light receiving portion of the sheet detecting sensor S1. Hence, the sheet detecting sensor S1 detects that there is no sheet under the gripper arm 221.

In contrast, as shown in FIG. 4, when there are the sheets P under the gripper arm 221, light from the light emitting portion of the sheet detecting sensor S1 is reflected by the sheets P and reaches the light receiving portion. Therefore the sheet detecting sensor S1 detects that there is a sheet under the gripper arm 221.

Sheet detection can be conducted when the conveyor belt 203 with the sheet grippers 220 has moved and the sensor holes 203*a* in the conveyor belt 203 have moved directly above the fixedly placed sheet detecting sensors S1. Positional information of the conveyor belt 203 at that time is given by a belt position determining sensor S2 (see FIG. 5).

(Controller)

Figure 5:
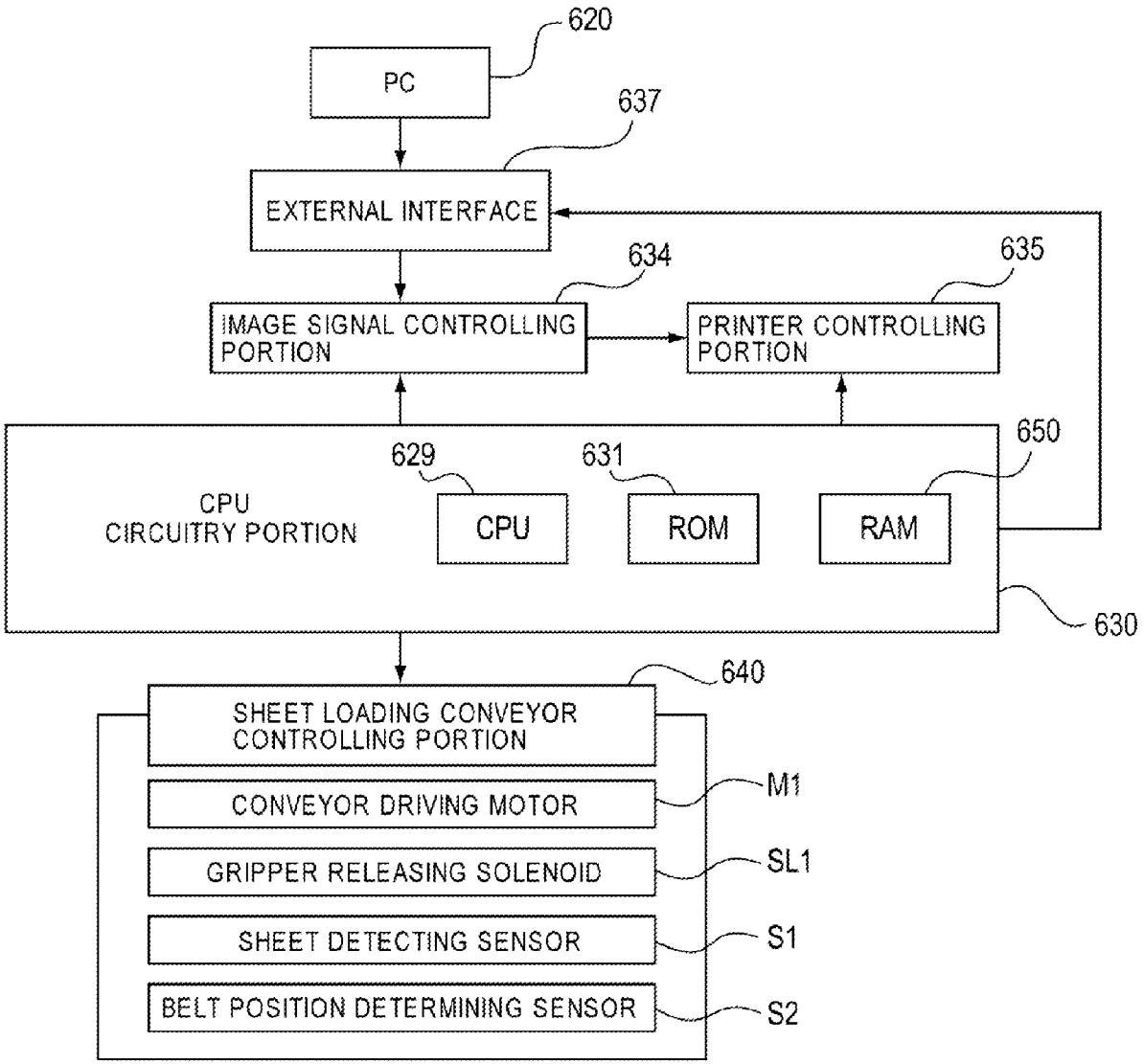
FIG. 5 is a block diagram of the image forming apparatus and a sheet stacking conveyor controlling portion according to the present invention.

FIG. 5 is a block diagram of an apparatus controller that controls the image forming apparatus 130 and the sheet stacking conveyor 200. As shown in FIG. 5, a CPU circuitry portion 630 includes a CPU 629, a ROM 631, and a RAM 650. The CPU circuitry portion 630 controls an image signal controlling portion 634, a printer controlling portion 635, a sheet stacking conveyor controlling portion 640, and an external interface 637.

The CPU circuitry portion 630 performs such control based on programs stored in the ROM 631. The printer controlling portion 635 controls the main body of the image forming apparatus 130. The sheet stacking conveyor controlling portion 640 controls the sheet stacking conveyor 200, and moreover, the sheet stacking conveyor controlling portion 640 controls the conveyor driving motor M1 and the gripper releasing solenoid SL1 based on signals from the sheet detecting sensors S1 and the belt position determining sensor S2 in the sheet stacking conveyor 200.

In this embodiment has been made the description of the structure in which the sheet stacking conveyor controlling portion 640 is provided to the sheet stacking conveyor 200; however the scope of the present invention is not limited to the embodiment: the sheet stacking conveyor controlling portion 640 integrated with the CPU circuitry portion 630 may be provided to the image forming apparatus 130 to control the sheet stacking conveyor 200 from the side of the image forming apparatus 130.

The RAM 650 is used as a region in which control data is to be temporarily held or a work area in which arithmetic operations accompanying the control are to be performed. The external interface 637, which is an interface for a computer (PC) 620, converts print data to image data and outputs the image data to the image signal controlling portion 634. Then the image data is output from the image signal controlling portion 634 to the printer controlling portion 635, following which the image data is input to an exposure controlling portion.

<Description of Operation of Sheet Stacking Conveyor>

Figure 6:
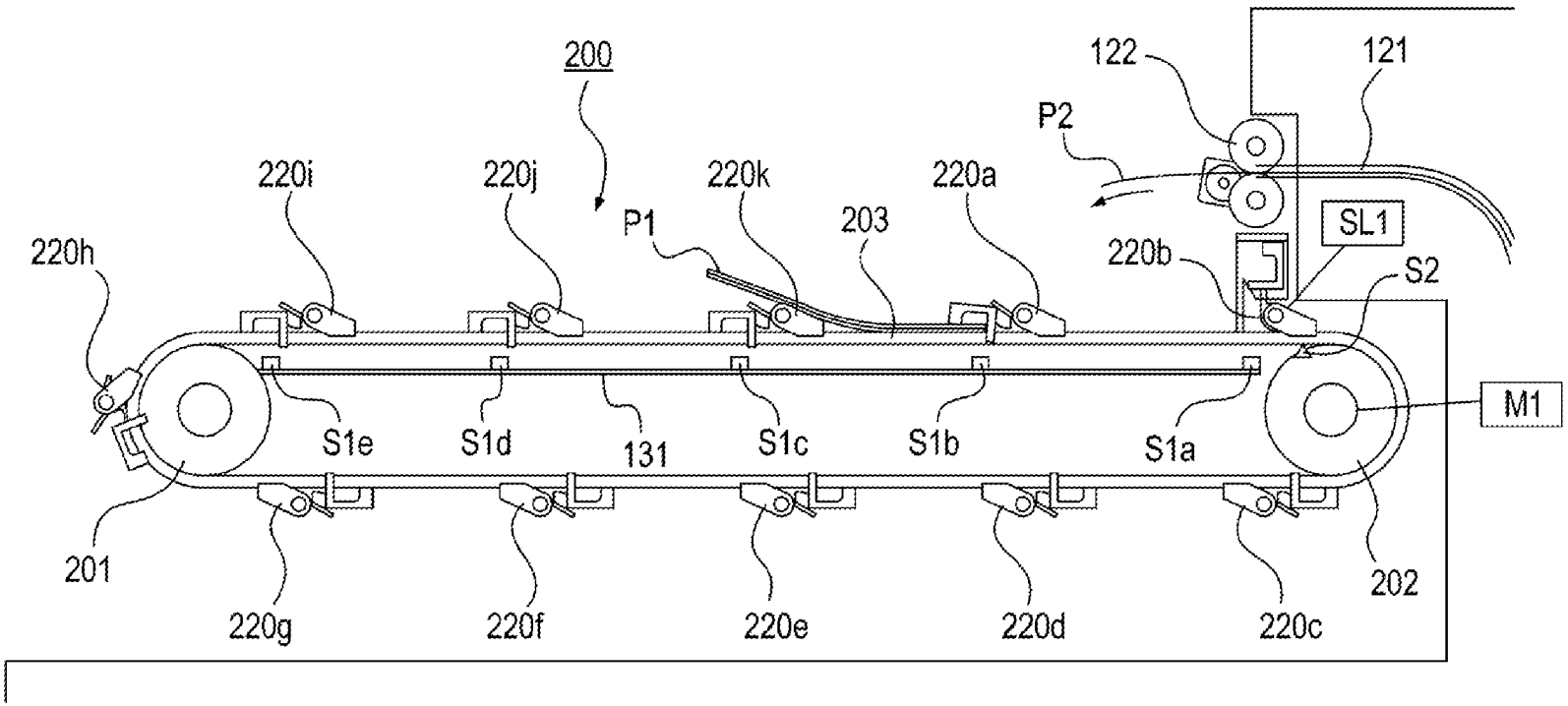
FIG. 6 is an explanatory drawing of operation of the sheet stacking conveyor according to the present invention.
Figure 7:
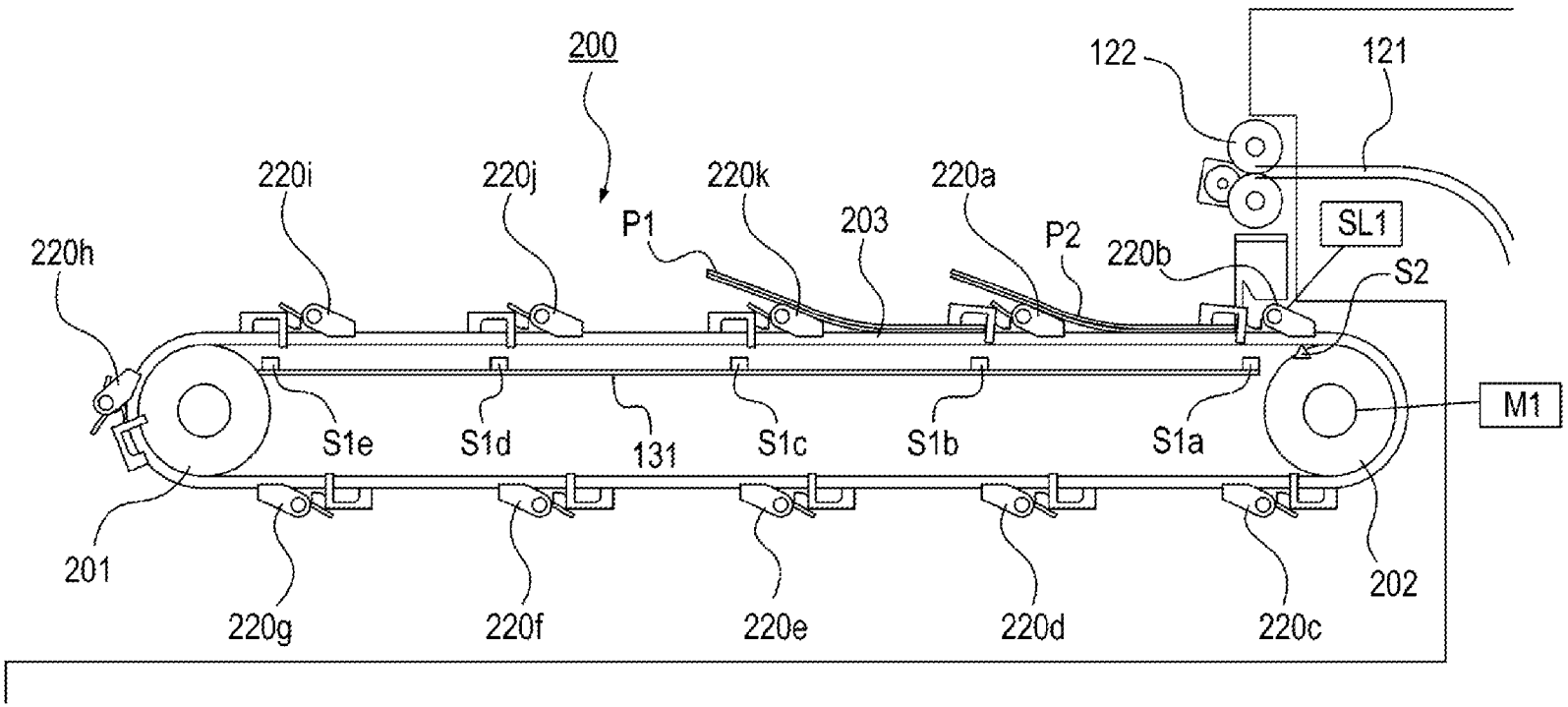
FIG. 7 is an explanatory drawing of operation of the sheet stacking conveyor according to the present invention.

Operation of the sheet stacking conveyor 200 will be described below with reference to FIGS. 6 to 8. FIGS. 6 and 7 are explanatory drawings of the operation of the sheet stacking conveyor 200, and FIG. 8 is a flowchart of the operation of the sheet stacking conveyor 200.

When an image formation job has been started by the image forming apparatus 130, the belt position determining sensor S2 determines whether the sheet gripper 220 on the sheet stacking conveyor 200 is at a sheet receiving position near the pair of discharge rollers 122 (steps S100 and S101). When the sheet gripper 220 is not at the sheet receiving position, the conveyor belt 203 is moved to the sheet receiving position by the conveyor driving motor M1 (step S102).

Then the sheet detecting sensor S1*a* placed near the sheet receiving position detects the presence or absence of a sheet in the sheet gripper 220 being at the sheet receiving position (steps S103 and S104). When it has been detected that there is a sheet at that time, it is thought that a sheet P1 for another job having printed out previously remains in the sheet gripper 220. In this case, to prevent intermingling with the sheet P1 for the different job, the sheet gripper 220*a* holding down the sheet P1 for the different job is moved downstream (step S105) until the next sheet gripper 220*b* reaches the sheet receiving position (steps S106 and S107).

Thereafter, in the case where it has been detected that there is no sheet in the sheet gripper 220 being on standby at the sheet receiving position, the gripper arm 221 is lifted by the gripper releasing solenoid SL1 to release the sheet gripper 220 (step S108). After the state of allowing any sheet to get in the sheet gripper 220 has been brought about like this, an image-formed sheet P2 is discharged from the pair of discharge rollers 122 onto the sheet stacking conveyor 200 (step S109: see FIG. 6).

When the last sheet of one set of sheets has been discharged (steps S110 and S111), the gripper releasing solenoid SL1 is released. Through the release of the solenoid SL1, the sheet gripper 220 holds the sheet P2 down to the periphery of the conveyor belt 203 with the potential energy of the gripper spring 222 to bring about a state of holding the sheet P2 (step S112: see FIG. 7), that is, the discharge of one set of sheets is completed.

In a job of printing plural sets of sheets, by performing the above operation on the individual sets of sheets, the interminglement of the discharged sets of sheets is prevented, i.e., the discharged sheets are sorted into the individual sets.

When one of the sheet grippers 220 is at the sheet receiving position, the sheet grippers 220 on the sheet stacking surface of the upper half of the sheet stacking conveyor 200 are directly above the sheet detecting sensors S1 (are opposite the sheet grippers). Therefore the presence or absence of sheets discharged at times of previous jobs can be detected, and the positions on the conveyor belt 203 of the detected sheets can be determined, whereby the positions of the stacked sheets can be presented to the user via the image forming apparatus or the PC.

In a case where the user has taken part of plural sets of sheets sorted with the sheets in imbricate state out of the sheet stacking conveyor 200, it is detected that there is no sheet in the sheet gripper 220 that has heretofore held down the set of sheets. That is, even in the state of being stacked with sheets in imbricate state, it can be precisely detected that the sheet gripper 220 is in the state of being released because part of plural sets of sheets has been taken out. Further, by moving the released sheet gripper 220 to the sheet receiving position again and then making the sheet gripper 220 hold down sheets for another job, the number of sortable sets of sheets can be maximized.

In this embodiment, sheets discharged onto the sheet stacking conveyor 200 in each job are held down by the sheet grippers 220 by the set. However, the holding power of the sheet grippers 220 is set so that the user can pull out any sheets by hand, and thus the user can take any sheets out of the sheet stacking conveyor 200 as appropriate with any timings.

According to this embodiment, sheets can be put under the gripper arms 221 only when the sheet grippers 220 are at the sheet receiving position. That is, once one set of sheets has been held down after the completion of the discharge of the set, other sheets cannot be put under the gripper arm 221. Therefore, even in the case where another set of sheets is partly put on the sheet gripper 200*a* as shown in FIG. 7, the sheets P1 between the gripper arm 221 and the sheet detecting sensor S1 placed inside the conveyor belt 203 can always be detected precisely.

Therefore, when the user desires to increase the number of sets of sheets that can be sorted on the sheet stacking conveyor 200, it can be thought that the spacing between the sheet grippers 220 is shortened so that the sets of sheets can be stacked with the sheets in imbricate state. In such a case as well, the sheets in the sheet grippers 220 can be detected precisely. Thus sheet position information on each set can be presented to the user.

In particular, as the number of sorted sets of sheets is increased, it becomes difficult for the user to take particular sheets out of the sheet stacking conveyor 200; however, in such a case too, the position of the sheets can be presented precisely. Thus the effect of improving convenience at the times when taking out sheets can be obtained.

Second Embodiment

Figure 9:
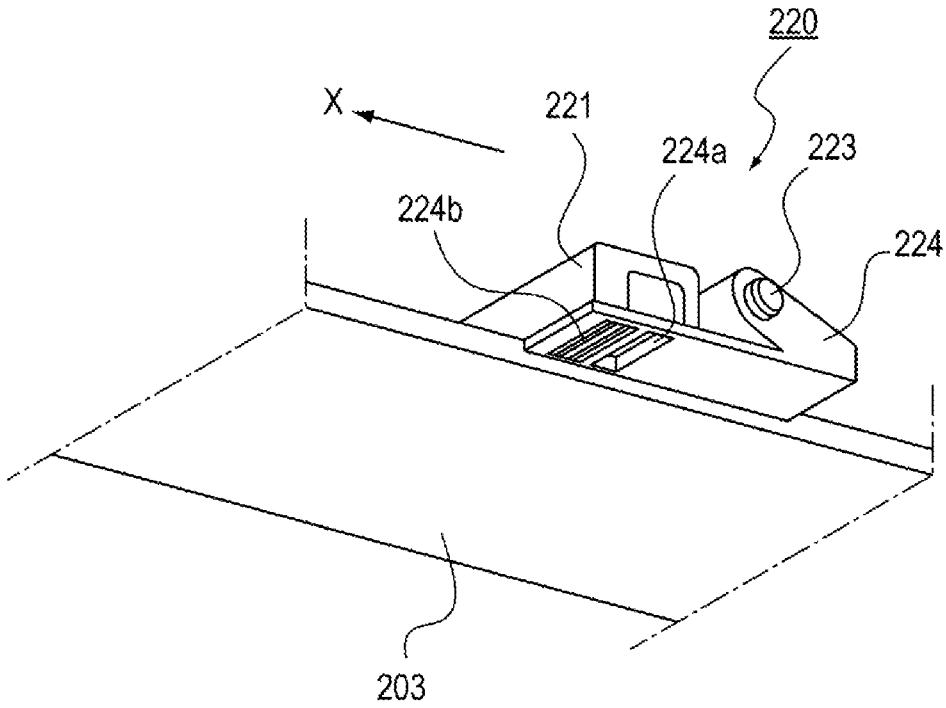
FIG. 9 is a perspective view of a sheet gripper according to the present invention.
Figure 10:
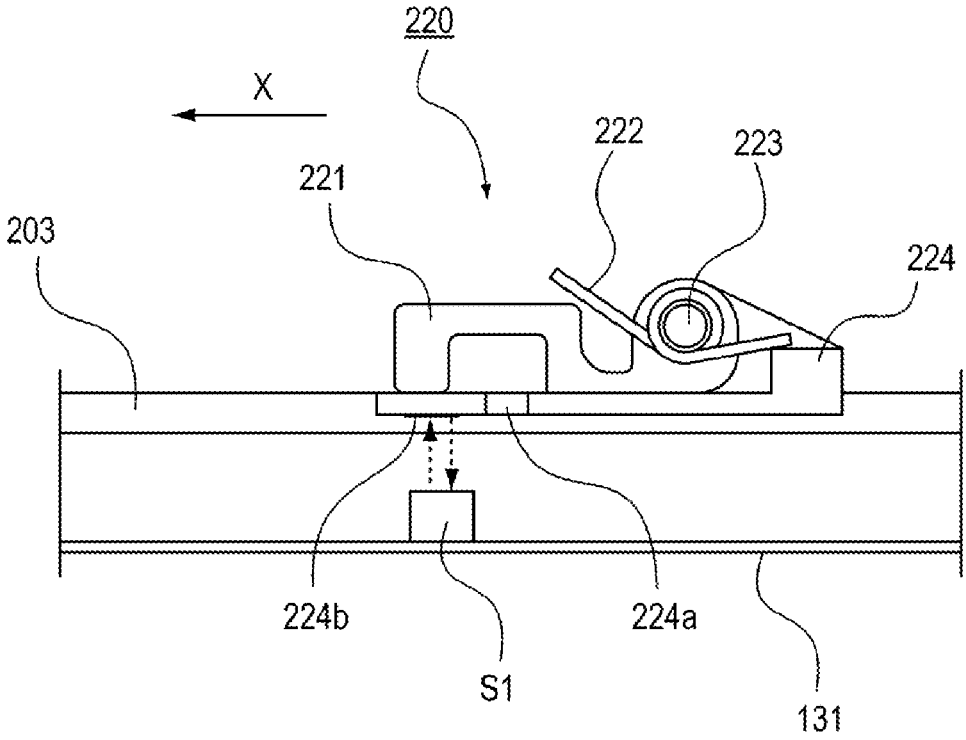
FIG. 10 is a cross-sectional view of the sheet gripper according to the present invention.
Figure 11:
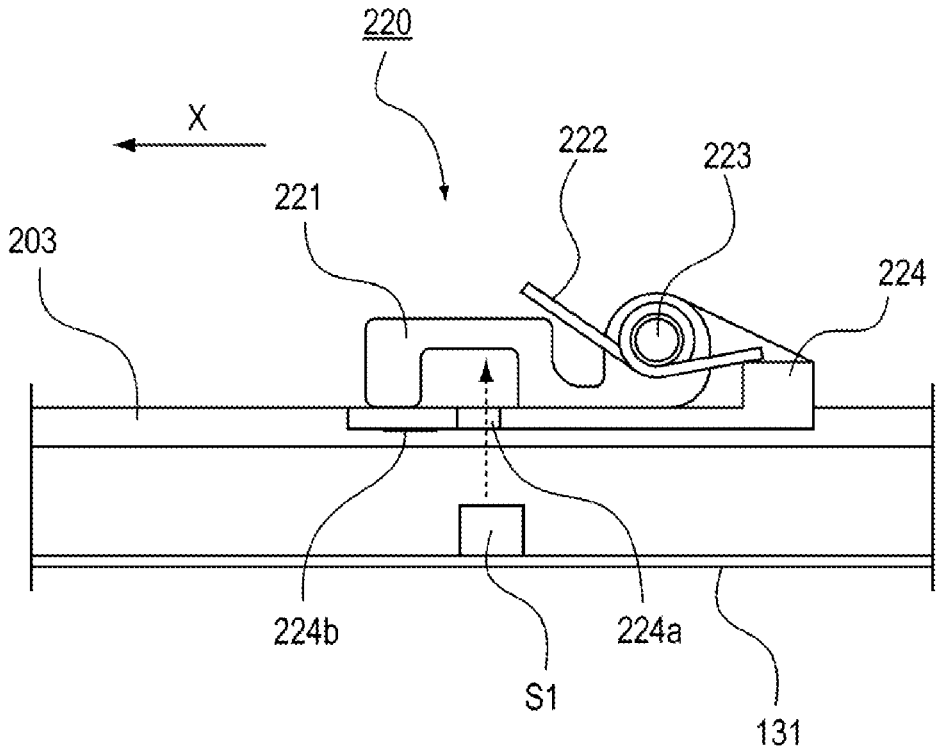
FIG. 11 is a cross-sectional view of the sheet gripper according to the present invention.
Figure 12:
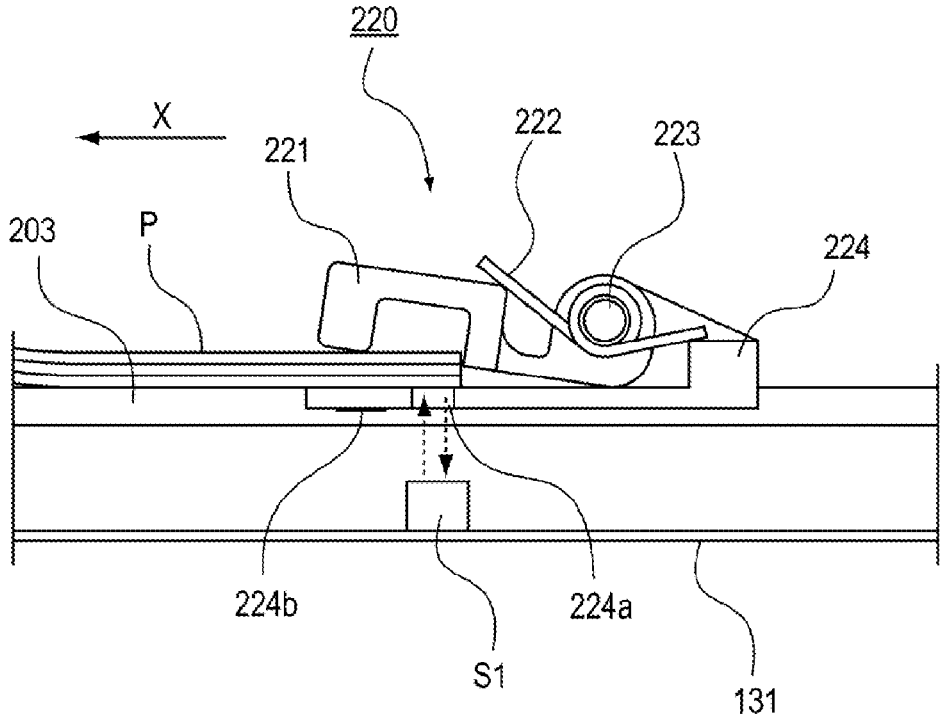
FIG. 12 is a cross-sectional view of the sheet gripper according to the present invention.
Figure 13:
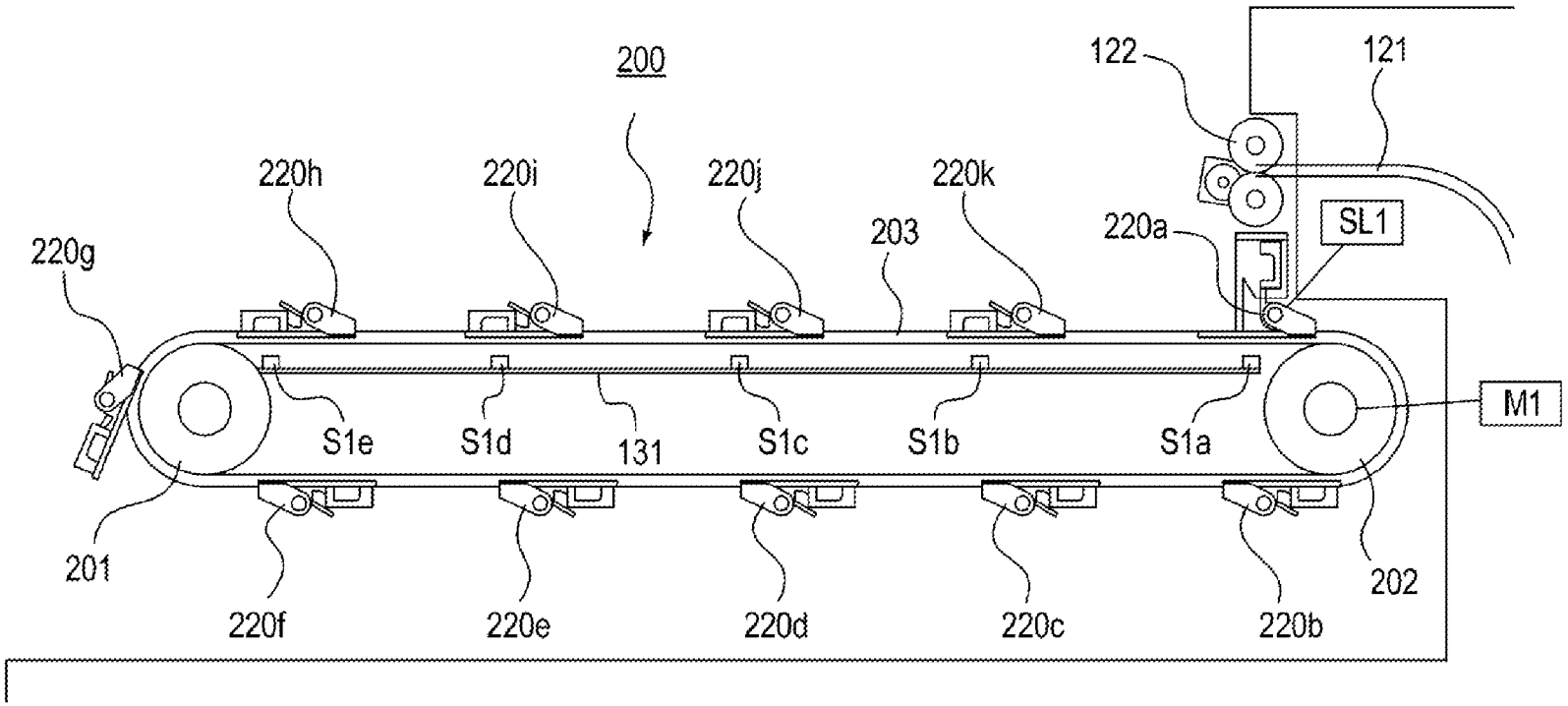
FIG. 13 is a cross-sectional view of the sheet stacking conveyor according to the present invention.
Figure 14:
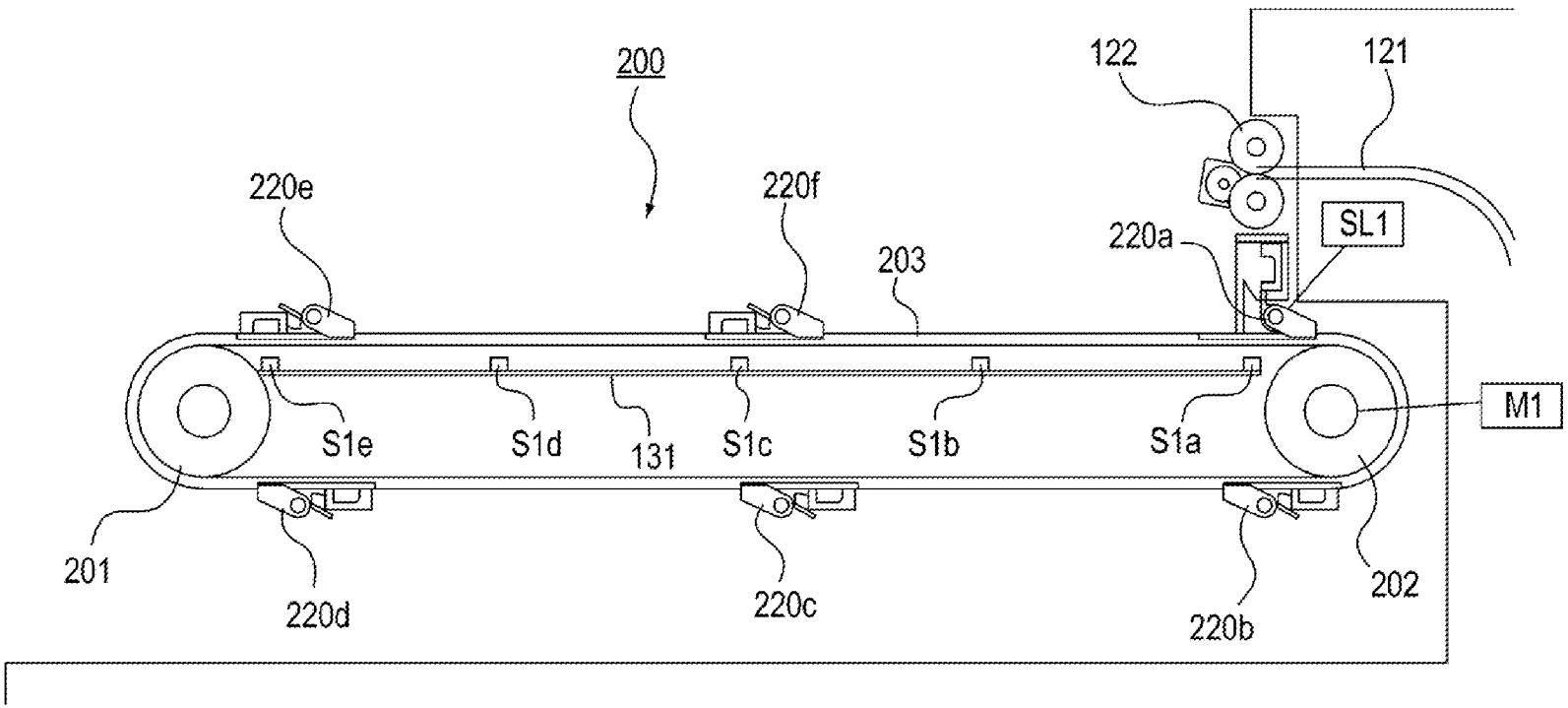
FIG. 14 is a cross-sectional view of the sheet stacking conveyor according to the present invention.
Figure 15:
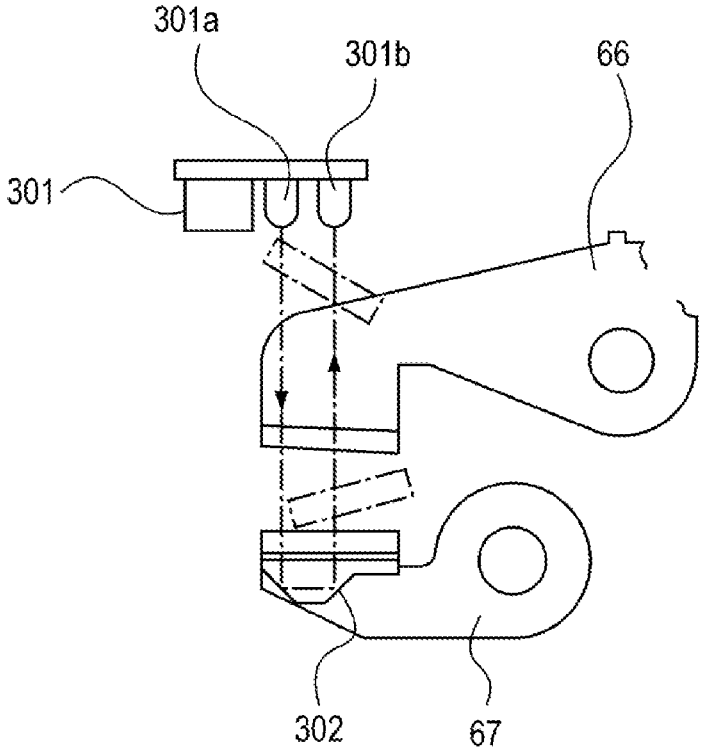
FIG. 15 PRIOR ART
FIG. 15 is a cross-sectional view of a related art gripper and a related art sheet detecting portion.

A Second Embodiment of the present invention will be described below with reference to FIGS. 9 to 14. FIG. 9 is a perspective view of a sheet gripper 220, FIGS. 10 to 12 are cross-sectional views of the sheet gripper 220, and FIGS. 13 and 14 are side views of the sheet stacking conveyor 200.

The same components as the components described in the first embodiment will be represented using the same reference numerals, and thus their detail descriptions will not be repeated.

In this embodiment, the gripper bases 224 of the sheet grippers 220 are not provided on the sheet stacking surface of the conveyor belt 203 but provided on outside of the sheet stacking surface of the conveyor belt 203 as shown in FIG. 9. Further, the sheet detecting sensors S1 are fixedly provided below the sheet stacking surface of the upper half of the conveyor belt 203 and on outside of the sheet stacking surface of the conveyor belt 203 in the width direction perpendicular to the sheet conveyance direction of the conveyor belt so that the sheet detecting sensors S1 detect the presence or absence of sheets at times when facing the gripper bases 224 of the sheet grippers 220. The gripper arms 221 hold the sheets down to the periphery of the conveyor belt 203.

Moreover, according to this embodiment, there is no sensor hole 203*a* in the conveyor belt 203, but as shown in FIG. 9, a gripper sensor hole (light-path hole) 224*a* is provided in the gripper base 224 of each sheet gripper 220. Further, to each gripper base 224, a gripper identifying member 224*b* used to identify the corresponding sheet gripper 220 is provided.

As shown in FIGS. 10 and 11, the gripper sensor holes 224*a* and the gripper identifying members 224*b* are provided so that both the components 224*a* and 224*b* pass directly above the sheet detecting sensors S1. Further, the gripper identifying members 224*b* are each provided downstream from the associated gripper sensor hole 224*a* in the direction of the conveyance of sheets (in the direction of an arrow X).

In/on the undersurfaces of the gripper identifying members 224*b*, different geometrical patterns are formed to make the sheet grippers 220 different in light reflectivity. Specifically, the gripper identifying members 224*b* each include a portion that reflects light emitted from the light emitting portion of the sheet detecting sensor S1 and a portion that absorbs the emitted light. The geometrical pattern on each gripper identifying member 224*b* is formed in a direction perpendicular to the direction of the conveyance of sheets held down by the sheet gripper 220 (to the direction of the arrow X).

When the gripper identifying member 224*b* of each sheet gripper 220 is passing directly above the sheet detecting sensor S1, the pattern of received light reflected to the light receiving portion of the sheet detecting sensor S1 is captured as a signal. By assigning the different geometrical patterns to the sheet grippers 220, the sheet grippers 220 can be identified, and at the same time positional information of the sheet grippers 220 can also be obtained.

The gripper identifying members 224*b* are not provided on the side of the periphery as the sheet stacking surface of the conveyor belt 203 but provided on the inside the inner periphery opposite to the sheet stacking surface of the conveyor belt 203. Therefore, in states in which the sheet grippers 220 are holding sheets, too, the sheet detecting sensors S1 can detect different identification signals for the sheet grippers 220.

Moreover, the conveyor belt 203 is not provided with the sensor holes 203*a*, but the sheet grippers 220 are each provided with the gripper identifying member 224*b* and the gripper sensor hole 224*a*. Further, the sheet grippers 220 are detachably provided to the conveyor belt 203. Therefore the sheet grippers 220 can be placed at any positions on the conveyor belt 203 in the direction of the rotational movement of the conveyor belt 203 according to sheet sizes.

<Determination of Sheet Gripper Positions and Detection of Sheets>

Operation at the times of the determination of sheet gripper 220 positions and operation at the times of the detection of sheets will be described below.

As shown in FIG. 10, the sheet grippers 220 on the conveyor belt 203 are moved in the conveyance direction X (the direction of the rotational movement of the conveyor belt 203). As described above, each gripper identifying member 224*b* is provided downstream from the associated gripper sensor hole 224*a* in the conveyance direction X. Therefore the gripper identifying member 224*b* for each sheet gripper 220 passes above the sheet detecting sensor S1 earlier than the gripper sensor hole 224*a*. At the time of the passing, an identification signal for the sheet gripper 220 is detected, and the position of the sheet gripper 220 is determined (see FIG. 10). Thereafter, the sheet gripper 220 is moved as it is, and at the time of the passing of the gripper sensor hole 224*a* above the sheet detecting sensor S1, the presence or absence of sheets under the gripper arm 221 is detected (see FIGS. 11 and 12).

A method for detecting sheets is the same as the method described in the first embodiment, and thus the description of the detection method according to this embodiment will not be repeated. As described above, the positions of the sheet grippers 220 are determined and sheets are detected by the sheet detecting sensors S1.

In the first embodiment, the sheet grippers 220 and the sheet detecting sensors S1 are placed at the same spacings, the positions of the sheet grippers 220 are determined by the belt position determining sensor S2, and the presence or absence of sheets is detected at times of the stopping of the sheet grippers 220.

On the other hand, in the second embodiment, the positions of the sheet grippers 220 can be determined and sheets can be detected via the gripper identifying members 224*b* and the gripper sensor holes 224*a* of the sheet grippers 220. Therefore the sheet grippers 220 can be placed at any positions on the conveyor belt 203. That is, the sheet grippers 220 can be placed at optimum spacings according to the sizes of sheets frequently used by the user.

For example, in cases where small sheets are frequently used, the spacing between the sheet grippers 220 can be shortened as shown in FIG. 13; in cases where large sheets are frequently used, the spacing between the sheet grippers 220 can be lengthened as shown in FIG. 14. By doing so, responses to the needs of the user can be made flexibly.

In the above embodiments, the gripper arms 221 are formed of a light-absorptive material, a method for absorbing light is not limited to such a method. For example, a method may be used in which the gripper arms 221 are formed of a material that does not absorb light. In such a method, a sheet-shaped member of a light-absorptive material is adhered to a portion of each gripper arm 221 so that light from the light emitting portion of the sheet detecting sensor S1 reaches the portion.

In the above embodiment has been made the description of the precise detection of different sets of sheets stacked with the sheets in imbricate state; and besides it is a matter of course that sheets in the sheet gripper can be detected precisely even in a state in which sheets for another job are not partly put on that sheet gripper.

Furthermore, in the above embodiment has been made the description in which one set of sheets is held down by one sheet gripper; however, the number of sets of sheets held down by one sheet gripper is not limited to such a one-to-one basis. Assuming that 100 sheets can be held down by one sheet gripper, plural sets of sheets can be held down by the sheet gripper within the range of 100 sheets. Further, with plural sets of sheets having printed out as one job, there is a need to stack the sets of sheets onto the conveyor belt 203 while changing the positions of the sheets in the width direction perpendicular to the sheet conveyance direction of the conveyor belt 203 set by set.

Moreover, in the above embodiment, the printer is used as the image forming apparatus by way of example; however, the scope of the present invention is not limited to such an embodiment. For example, a copying machine, a scanner, a facsimile machine, a multifunction apparatus in which a copy function, a scan function, and a fax function are combined, or the like may be used as the image forming apparatus. By applying the present invention to sheet stacking apparatuses used in those image forming apparatuses, the same effect as that described above can be obtained. Further, in cases of stacking and conveying sheets subjected to hole-punching processing, stapling processing, folding processing, bookbinding processing, or the like by a sheet processing apparatus and the sheaves of the sheets too, the same effect as that described above can be obtained.

Also, in the above embodiment, the integral-type sheet stacking apparatus is provided to the image forming apparatus by way of example, but the scope of the present invention is not limited to such an embodiment. For example, a detachable sheet stacking apparatus may be provided to the image forming apparatus; by applying the present invention to such a sheet stacking apparatus, the same effect as that described above can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-139033, filed Jun. 23, 2011, and No. 2012-118255, filed May 24, 2012, which are hereby incorporated by reference herein in their entirety.

What is claimed is:

1. A sheet stacking apparatus comprising:

an endless belt member onto which sheets are stacked and which moves rotationally to convey the sheets;

a holding member that holds the sheets down to a sheet stacking surface of the belt member to nip the sheets; and a sheet detecting portion which detects a presence or absence of sheets between the holding member and the sheet stacking surface of the belt member, the sheet detecting portion including a light emitting portion that emits light and a light receiving portion that receives the light from the light emitting portion, and the light emitting portion and the light receiving portion are fixedly provided below the sheet stacking surface of the belt member, wherein the holding member includes a light-absorptive material which absorbs and does not reflect the light from the light emitting portion when a sheet is absent between the holding member and the sheet stacking surface of the belt member.

2. The sheet stacking apparatus according to claim 1, wherein the light from the light emitting portion has been received by the light receiving portion after reflection of the light from the sheet when a sheet is present between the holding member and the sheet stacking surface of the belt member, and the light from the light emitting portion has been absorbed by the holding member instead of being reflected when a sheet is absent between the holding member and the sheet stacking surface of the belt member.

3. The sheet stacking apparatus according to claim 1, wherein the holding member is provided on the sheet stacking surface of the belt member, and wherein the belt member has a light-path hole through which the light is to be passed at a position where the sheet detecting portion is opposite the holding members.

4. The sheet stacking apparatus according to claim 1, wherein the holding member is provided on outside of the sheet stacking surface of the belt member in the width direction perpendicular to the sheet conveyance direction, wherein the holding member includes a base mounted on the belt member, and wherein the base of the holding member has a light-path hole through which the light is to be passed where the sheet detecting portion is opposite the holding member.

5. The sheet stacking apparatus according to claim 4, wherein a plurality of the holding member and a plurality of the sheet detecting portion are provided, wherein each of the holding members includes identification members on which geometrical patterns are formed to make the holding members different in light reflectivity, and wherein each of the sheet detecting portions identifies the holding members and determines positions of the holding members with light reflected from the identification members.

6. The sheet stacking apparatus according to claim 4, wherein the holding member can be detachably provided at any positions on the side surface of the belt member in the direction of the rotational movement of the belt member.

7. The sheet stacking apparatus according to claim 1, wherein a plurality of the holding member and a plurality of the detecting portion are provided.

8. The sheet stacking apparatus according to claim 1, wherein the holding member is provided on the belt member.

9. An image forming apparatus comprising:

an image forming portion which forms an image on sheets; and a sheet stacking apparatus onto which the image-formed sheets are stacked to convey the sheets, the sheet stacking apparatus comprises:

an endless belt member onto which the sheets are stacked and which moves rotationally to convey the sheets;

a holding member that holds the sheets down to a sheet stacking surface of the belt member to nip the sheets; and a sheet detecting portion that detects a presence or absence of sheets between the holding member and the sheet stacking surface of the belt member, the sheet detecting portion including a light emitting portion that emits light and a light receiving portion that receives the light from the light emitting portion, and the light emitting portion and the light receiving portion are fixedly provided below the sheet stacking surface of the belt member, wherein the holding member includes a light-absorptive material which absorbs and does not reflect the light from the light emitting portion when a sheet is absent between the holding member and the sheet stacking surface of the belt member.

10. The image forming apparatus according to claim 9, wherein the light from the light emitting portion has been received by the light receiving portion after reflection of the light from the sheet when a sheet is present between the holding member and the sheet stacking surface of the belt member, and the light from the light emitting portion has been absorbed by the holding member instead of being reflected when a sheet is absent between the holding member and the sheet stacking surface of the belt member.

11. The image forming apparatus according to claim 9, wherein the holding member is provided on the sheet stacking surface of the belt member, and wherein the belt member has a light-path hole through which light is to be passed at a position where the sheet detecting portion is opposite the holding member.

12. The image forming apparatus according to claim 9, wherein the holding member is provided on an outside of the sheet stacking surface of the belt member in the width direction perpendicular to the sheet conveyance direction, wherein the holding member includes a base mounted on the belt member, and wherein the base of the holding member has a light-path hole through which the light is to be passed where the sheet detecting portion is opposite the holding member.

13. The image forming apparatus according to claim 12, wherein a plurality of the holding member and a plurality of the sheet detecting portion are provided, wherein each of the holding members includes identification members on which geometrical patterns are formed to make the holding members different in light reflectivity, and wherein each of the sheet detecting portions identifies the holding members and determines positions of the holding members with light reflected from the identification members.

14. The image forming apparatus according to claim 12, wherein the holding member can be detachably provided at any positions on the side surface of the belt member in the direction of the rotational movement of the belt member.

15. The image forming apparatus according to claim 9, wherein a plurality of the holding member and a plurality of detecting portion are provided.

16. The image forming apparatus according to claim 9, wherein the holding member is provided on the belt member.

* * * * *